US011198602B2

(12) United States Patent
Dirx et al.

(10) Patent No.: US 11,198,602 B2
(45) Date of Patent: Dec. 14, 2021

(54) BEVERAGE TAP INSTALLATION

(71) Applicant: Anheuser-Busch InBev S.A., Brussels (BE)

(72) Inventors: Lieven Dirx, Leuven (BE); Stijn Vandekerckhove, Leuven (BE)

(73) Assignee: Anheuser-Busch InBev S.A., Brussels (BE)

( * ) Notice: Subject to any disclaimer, the term of this patent is extended or adjusted under 35 U.S.C. 154(b) by 91 days.

(21) Appl. No.: 16/081,663

(22) PCT Filed: Mar. 2, 2017

(86) PCT No.: PCT/EP2017/054931
§ 371 (c)(1),
(2) Date: Aug. 31, 2018

(87) PCT Pub. No.: WO2017/149085
PCT Pub. Date: Sep. 8, 2017

(65) Prior Publication Data

US 2021/0107781 A1 Apr. 15, 2021

(30) Foreign Application Priority Data

Mar. 2, 2016 (EP) ..... 16158257

(51) Int. Cl.
*B67D 1/14* (2006.01)
*B67D 1/00* (2006.01)

(52) U.S. Cl.
CPC ..... *B67D 1/1477* (2013.01); *B67D 1/0082* (2013.01); *B67D 1/1444* (2013.01); *B67D 2001/0089* (2013.01)

(58) Field of Classification Search
CPC ..... B67D 3/04; B67D 2001/0089; B67D 2001/0095; B67D 1/14; B67D 1/1477;
(Continued)

(56) References Cited

U.S. PATENT DOCUMENTS 4,700,926 A * 10/1987 Hansen ..... F16L 37/42 251/149.8
5,244,117 A * 9/1993 Lombardo ..... B67D 1/0456 141/3

(Continued)

FOREIGN PATENT DOCUMENTS

CN 2365190 2/2000
CN 102627248 8/2012

(Continued)

*Primary Examiner* — Jeremy Carroll
(74) *Attorney, Agent, or Firm* — Levy & Grandinetti

(57) ABSTRACT

A beverage tap installation includes a tap housing defining an inner cavity and a tap head defining a liquid channel having an inlet, outlet, and a valve receiving slot. The tap head includes a valve actuator and a valve actuator operating mechanism. A removable flexible dispense tube has a beverage inlet and outlet, the flexible dispense tube includes a liquid valve lodged in the valve receiving slot and cooperates with the valve actuator. A locking mechanism allows removably mounting the tap head on the tap housing. The flexible dispense tube includes an abutment surface in proximity of the valve and the tap installation having an engaging member on the tap head or the tap installation and abutting the dispense tube when the valve is lodged in the valve receiving slot. The tap head is mounted on the tap housing and the engaging member is provided on the tap housing.

19 Claims, 13 Drawing Sheets

(58) Field of Classification Search
CPC ... B67D 1/0082; B67D 1/1444; B67D 1/1405
USPC ..... 222/505, 529, 630–633, 206–215
See application file for complete search history.

(56) References Cited

U.S. PATENT DOCUMENTS

| | | | | |
|---|---|---|---|---|
| 5,971,218 | A * | 10/1999 | Le | B67D 3/04 220/324 |
| 7,188,751 | B2 * | 3/2007 | Van Der Klaauw | B67D 1/0082 222/146.6 |
| 7,661,556 | B2 * | 2/2010 | van der Klaauw | B67D 1/0868 222/1 |
| 7,806,299 | B2 * | 10/2010 | Wauters | B67D 1/127 222/129.1 |
| 8,038,039 | B2 * | 10/2011 | Kelly | B67D 1/0418 222/399 |
| 8,141,755 | B2 * | 3/2012 | Kelly | B05B 1/30 222/399 |
| 8,490,836 | B2 * | 7/2013 | Rasmussen | B67D 1/0878 222/146.6 |
| 9,016,526 | B2 | 4/2015 | Evans et al. | |
| 9,221,666 | B2 * | 12/2015 | Vandekerckhove | B67D 1/0829 |
| 9,463,968 | B2 * | 10/2016 | Schaefer | B67D 3/0058 |
| 9,834,428 | B2 | 12/2017 | Dahl et al. | |
| 9,896,323 | B2 * | 2/2018 | Rasmussen | B67D 1/1411 |
| 10,280,059 | B2 * | 5/2019 | Peirsman | B67D 1/0891 |
| 10,301,161 | B2 * | 5/2019 | Lux | B67D 3/0025 |
| 10,501,306 | B2 * | 12/2019 | Donabauer | B67D 1/0004 |
| 2004/0226967 | A1 * | 11/2004 | Van Der Klaauw | B67D 1/1422 222/146.6 |
| 2010/0181336 | A1 * | 7/2010 | Rasmussen | B67D 1/1416 222/1 |
| 2010/0192598 | A1 * | 8/2010 | Rasmussen | B67D 1/0865 62/56 |
| 2013/0221034 | A1 * | 8/2013 | Vandekerckhove | B67D 1/0829 222/394 |

FOREIGN PATENT DOCUMENTS

| | | |
|---|---|---|
| CN | 203048571 | 7/2013 |
| EP | 2 179 961 | 4/2010 |
| EP | 2 213 614 | 8/2010 |

* cited by examiner

BEVERAGE TAP INSTALLATION

FIELD OF THE INVENTION

The present invention concerns a beverage tap installation, in particular a beverage tap installation of the type having a removable dispense tube for guiding the beverage from a beverage source to the serving vessel, the dispense tube defining the spout of the beverage tap installation.

BACKGROUND OF THE INVENTION

In a beverage tap installation, generally, a dispense tube is provided having a connector which is configured to cooperate with a valve and a flexible tube extending from the connector into a nozzle through which beverage leaves the dispense tube and flows into the serving vessel. For hygiene reasons, it has been known for a while to use disposable dispense tubes in beverage tap installations to prevent the beverage from contacting any hardware of the installation with exception of the beverage dispense tube during transfer from the beverage source to the vessel wherein the beverage is served.

In order to replace the dispense tube, the tap installations have been developed allowing insertion of the dispense tube bottom upwards through a font. In that case, the connector, which is usually the most bulky part of the dispense tube, does not need to be transferred through the font. In order to facilitate the transfer of the spout end of the dispense tube through the font, the spout end is manufactured as sleek as possible. The part of the font in proximity of the tap head usually comprises an access point at which the spout end of the dispense tube may be caught and further manually introduced in the tap head.

In such installations, the tap head is usually configured as a pinch valve allowing pinching the dispense tube in proximity of the spout to open and close the dispense tube. Pinch valves usually provides a good control on the open and closing of the dispense tube and hence the flow rate of the beverage, when applied on dispense tubes having a high flexibility. However, the functionality and precision of a pinch valve is still not comparable to other type of valves such as rotary valves or ball valves. Unlike pinch valves however, operating rotary valves or ball valves require a very precise positioning of the valve in view of valve actuating means such as a tap handle to allow correct operation.

So far it has been proven difficult to ensure a correct positioning of a dispense tube in a beverage tap installation, when the dispense tube includes a valve disposed in a tap head and a valve actuation mechanism, provided in the tap head, cooperates with the valve for opening and closing the dispense tube, and hence impractical for pub holders or for bartenders.

Therefore, there is a need for beverage tap installations with valves which provide precise control over flow of the beverage and further allow for easy replacement of the dispense tube.

SUMMARY OF THE INVENTION

The present invention addresses the above mentioned need and concerns a beverage tap installation comprising:

a tap housing defining an inner cavity;

a tap head defining a liquid channel having an inlet and an outlet and a valve receiving slot defined in said liquid channel, the tap head comprising a valve actuator and a valve actuator operating mechanism;

a removable flexible dispense tube having a beverage inlet and a beverage outlet, characterized in that the flexible dispense tube comprises a liquid valve lodged in the valve receiving slot and cooperates with the valve actuator of the tap head.

The beverage tap installation preferably comprises a locking mechanism allowing removably mounting the tap head on the tap housing.

According to a preferred embodiment, the beverage tap installation comprises a valve locking mechanism allowing locking the valve in the valve receiving slot.

DETAILED DESCRIPTION

Figure 1:
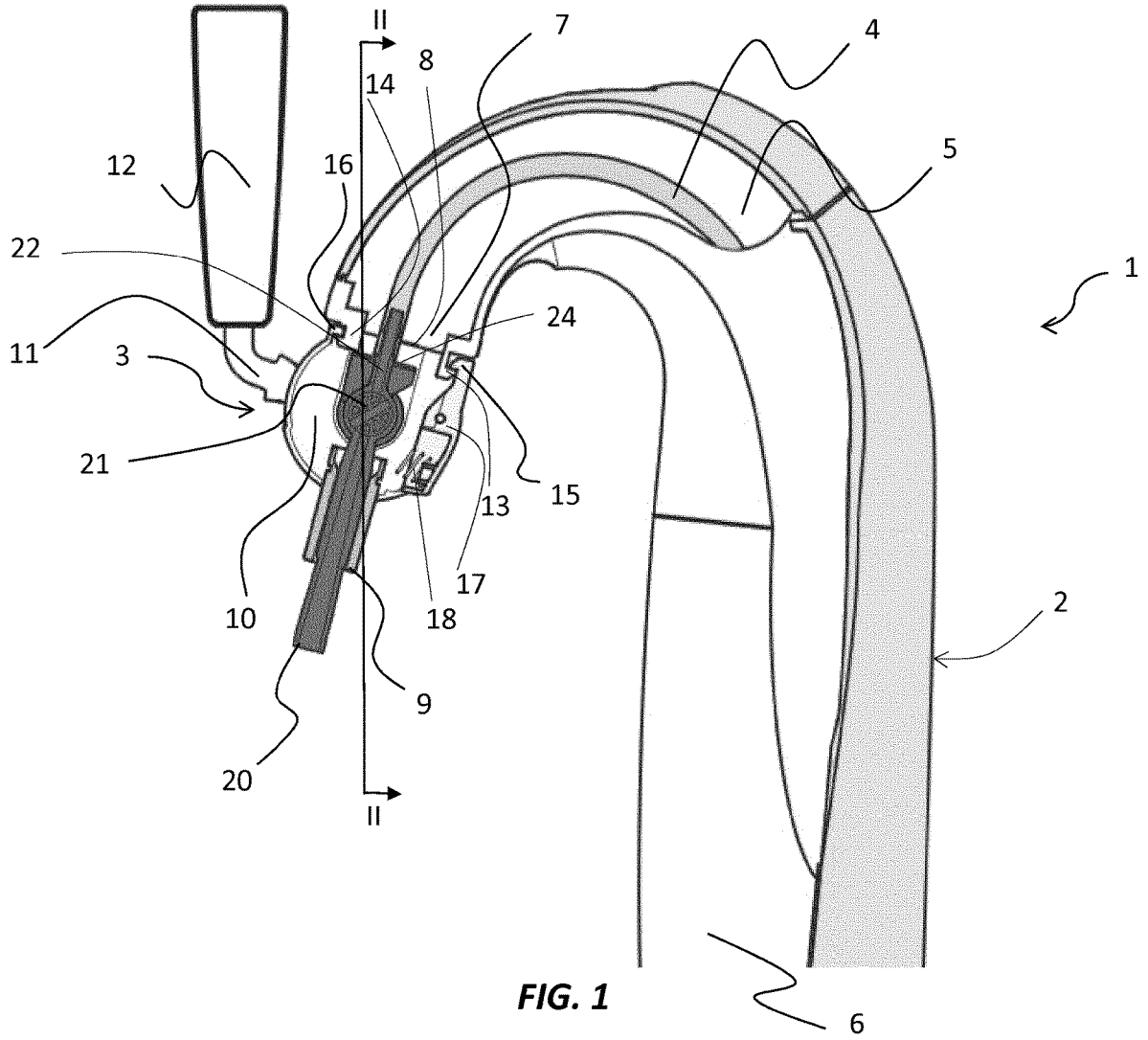
FIG. 1 is a sectional view of a beverage tap installation, according to an embodiment of the present invention.

FIG. 1 represents a first embodiment of a beverage tap installation 1 according to the present invention and in this case comprises a tap housing 2 in the form of an elongated tapping column—often called a tap font or tap tower—and a tap head 3 and a flexible dispense tube 4 at least partially extending through the tap housing 2 and the tap head 3.

The tap housing 2 comprises an inner cavity 5 that in this case extends from a tap housing inlet 6 at a base of the tap housing 2 to a tap housing outlet at an opposed end 7 of the tap housing 2.

The tap head 3 defines a liquid channel having a tap head inlet 8 and a tap head outlet 9 and a valve receiving slot 10 defined in said liquid channel. The tap head 3 comprises a valve transmission 23 connected to a valve actuator 11 and a valve actuator operating mechanism 12, in this case a tap handle.

As depicted in FIG. 1, the tap installation preferably comprises a locking mechanism allowing removably mounting the tap head 3 on the tap housing 2. In this case the locking mechanism comprises a pair of hooks 13-14 provided on the opposed end 7 of the tap housing and a pair of L-shaped members 15-16 provided on the tap head at the inlet 8. One of these L-shaped members 15, is provided on a hinging arm 17 allowing varying the distance between the L-shaped members 15 and 16 and biased by a spring 18 in a direction in which the distance between the L-shaped members 15-16 is minimized. Hinging of the arm 17 against the spring hence allows moving the L-shaped members apart and lodging these behind the hooks 13-14 of the tap housing and thereby locking the tap head 3 on the tap housing 2.

In this case the L-shaped members 15-16 delimit the tap head inlet 8, while the hooks 13-14 delimit the tap housing outlet 7. As the distance between the hooks 13-14 is smaller than the distance between the L-shaped members 15-16 of the tap head, part of the hooks 13-14 extends over or in the tap head inlet 8 when the tap head is mounted on the tap housing 2.

Figure 2:
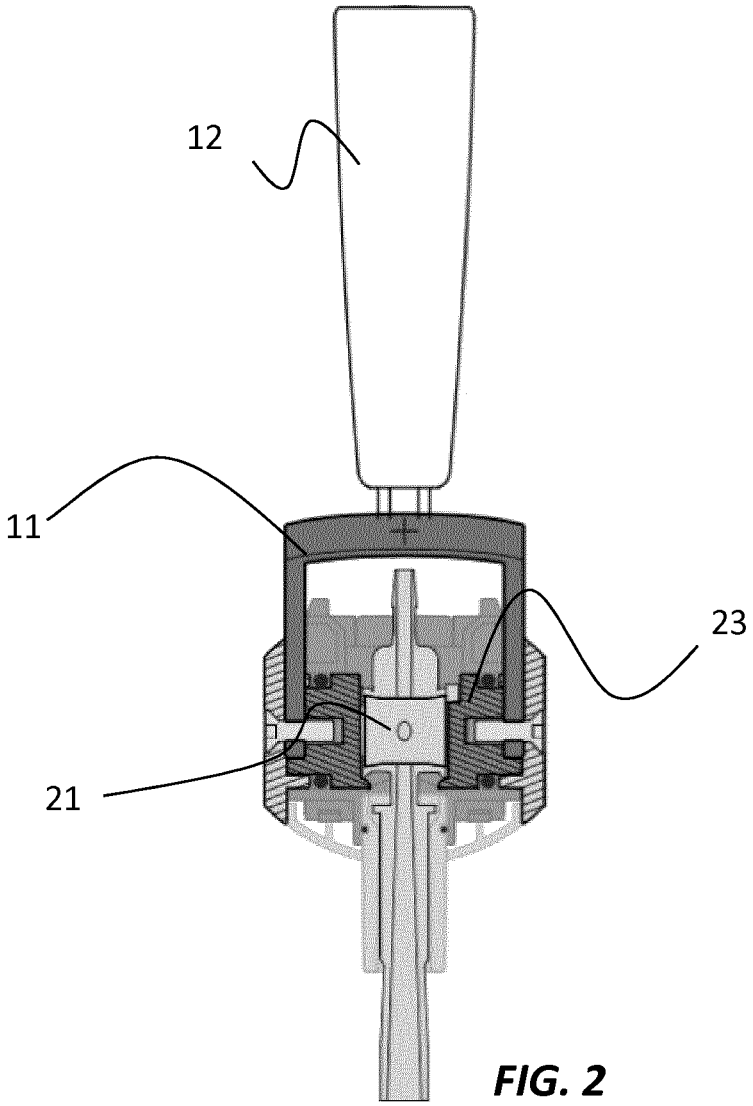
FIG. 2 is a cross-sectional view of the tap beverage installation in FIG. 1 according to line II-II.

According to the present invention, the flexible dispense tube 4 comprises a beverage inlet (not shown) and a beverage outlet 20 and a liquid valve 21. Preferably, and as represented in FIG. 1, the dispense tube comprises a rigid section 22 wherein the liquid valve 21 is provided that cooperates with the valve transmission 23 (FIG. 2) for operating the liquid valve 21 through the valve actuator 11 provided in the tap head 3.

The dispense tube further preferably comprises an abutment surface 24 provided in proximity of the liquid valve 21 and preferably provided on the above mentioned rigid section 22.

Figure 3:
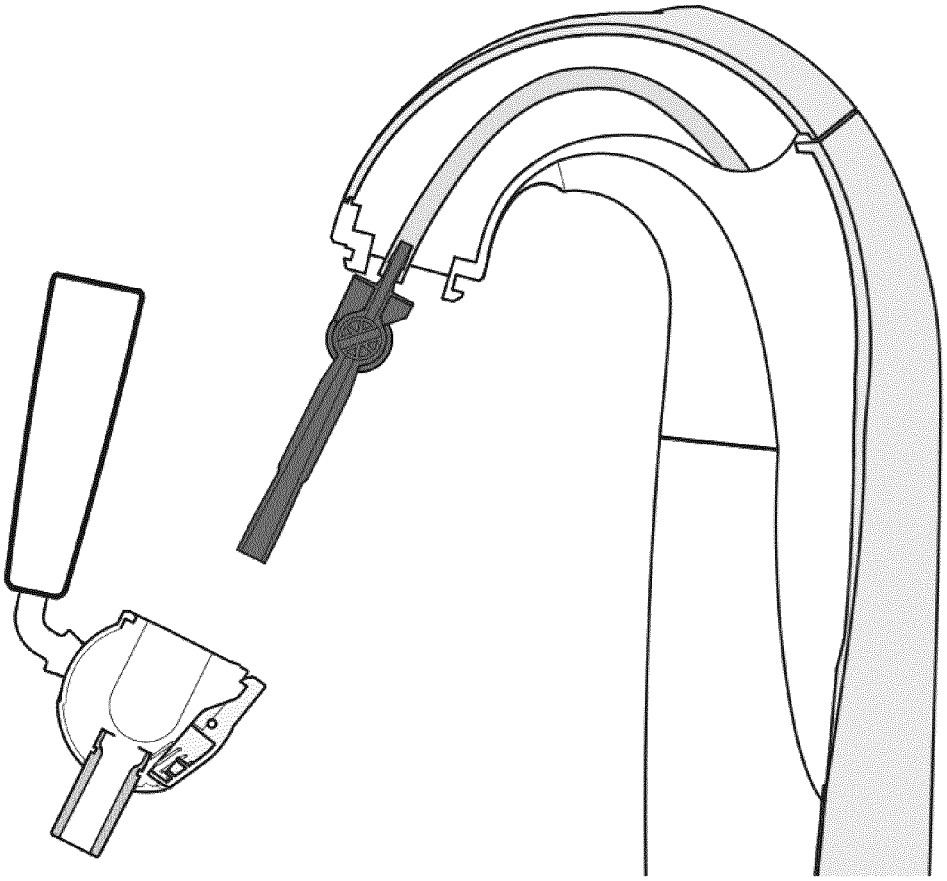
FIGS. 3, 4 and 5 show the tap installation of FIG. 1 during several assembly steps.
Figure 4:
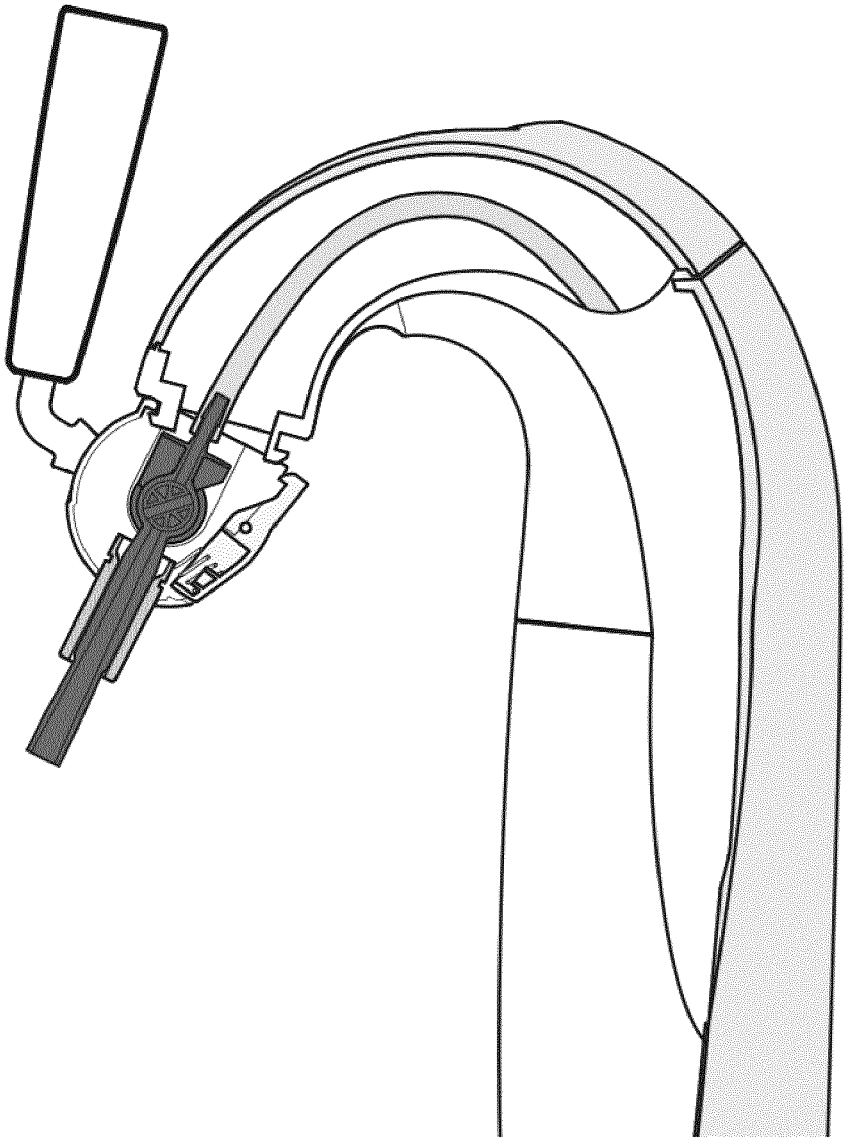
Figure 5:
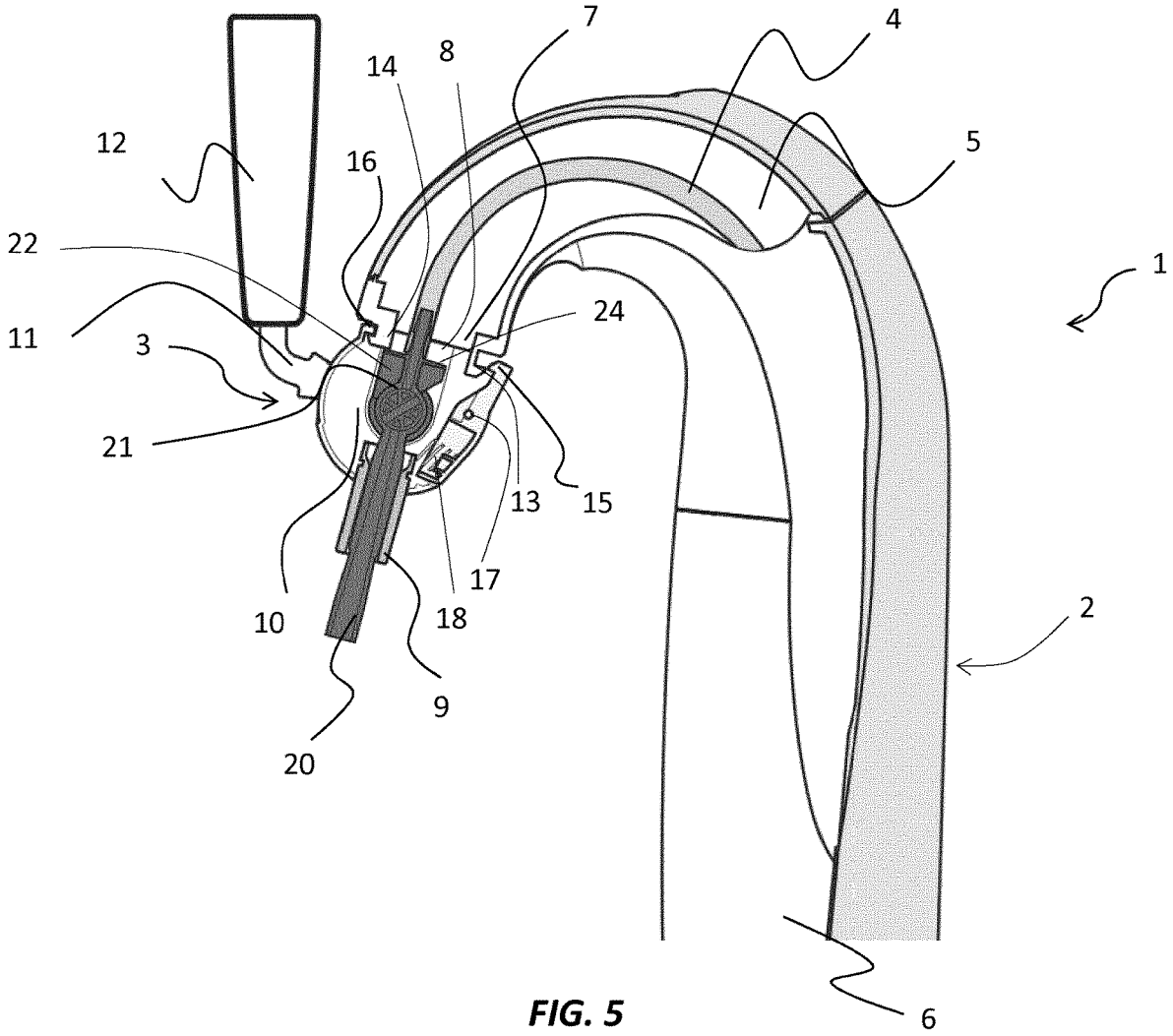

FIGS. 3, 4 and 5 schematically show the introduction of a flexible tube 4 in the tap head 3 and a locking of the tap head 3 to the tap housing 2 in preparation of dispensing a beverage through the tap installation.

In FIG. 3, the tap head 3 is removed from the tap housing 2 and a dispense tube 4 is introduced through the inner cavity of the tap housing, with the beverage outlet 20 and the rigid section 22 of the dispense tube 4 perking out of the tap housing outlet 7.

In order to assemble the tap installation 1, the beverage outlet 20 is inserted in the tap head until the beverage outlet extends until at least the tap head outlet and the rigid section 22 is inserted in the valve receiving slot. Preferably at least slightly beyond the tap head outlet such as to form the spout of the tap installation.

Next the tap head 3, with the dispense beverage outlet 20 of the dispense tube inserted therein is connected to the tap housing 2. As depicted in FIGS. 4 and 5 this connection is achieved by placing a first L-shaped member 16 in the corresponding hook 14 of the tap housing, and subsequently hinging the tap head to engage the second L-shaped member 15 with the second hook 13. Dependent on the design of the L-shaped member 15 and the hook 13 it might be necessary to push/pull the hinging arm 17 against the force of the spring 18 to a position wherein the distance between the L-shaped members 15-16 is sufficiently large to tilt the second L-shaped member 15 over hook 13. By subsequently releasing the hinging arm 17, the spring 18 will move the L-shaped members 15-16 together and the tap head 3 is locked to the tap housing 2. As depicted in FIG. 4, during connecting the tap head to the tap housing, the first hook 14 contacts the abutment surface 24 of the dispense tube, thereby forcing the liquid valve 21 of the dispense tube 4 in the valve receiving slot 10 to a position (depth) wherein the valve transmission 23 engages with the liquid valve 21 of the dispense tube 4 and correct operation of the valve by means of the handle is ensured. The first hook 14 hereby functions as an engaging member forcing and holding the liquid valve 21 in a correct position in the tap head.

The first hook 14 and abutment surface 24 hereby interact independent of the valve and are separate from the valve such that the positioning of the valve in the tap head does not affect further operation of the liquid valve by the handle 12. In order not to squeeze the dispense tube during locking and holding the liquid valve in place in the tap head, it is preferred that the abutment surface 24 and the force applied thereon by the first hook 14 extends in a direction substantially perpendicular to the longitudinal direction of the dispense tube.

In order to replace the dispense tube 4, it suffices to remove the tap head 3 from the tap housing 3, whereby the first hook 14 disengages the abutment surface 24 of the dispense tube 4 and the tap head inlet becomes accessible. Once removed, the dispense tube 4 can easily be removed from the tap head 3 by pulling it out. Subsequently the dispense tube can be removed from the tap housing and replaced by a new one.

Figure 6:
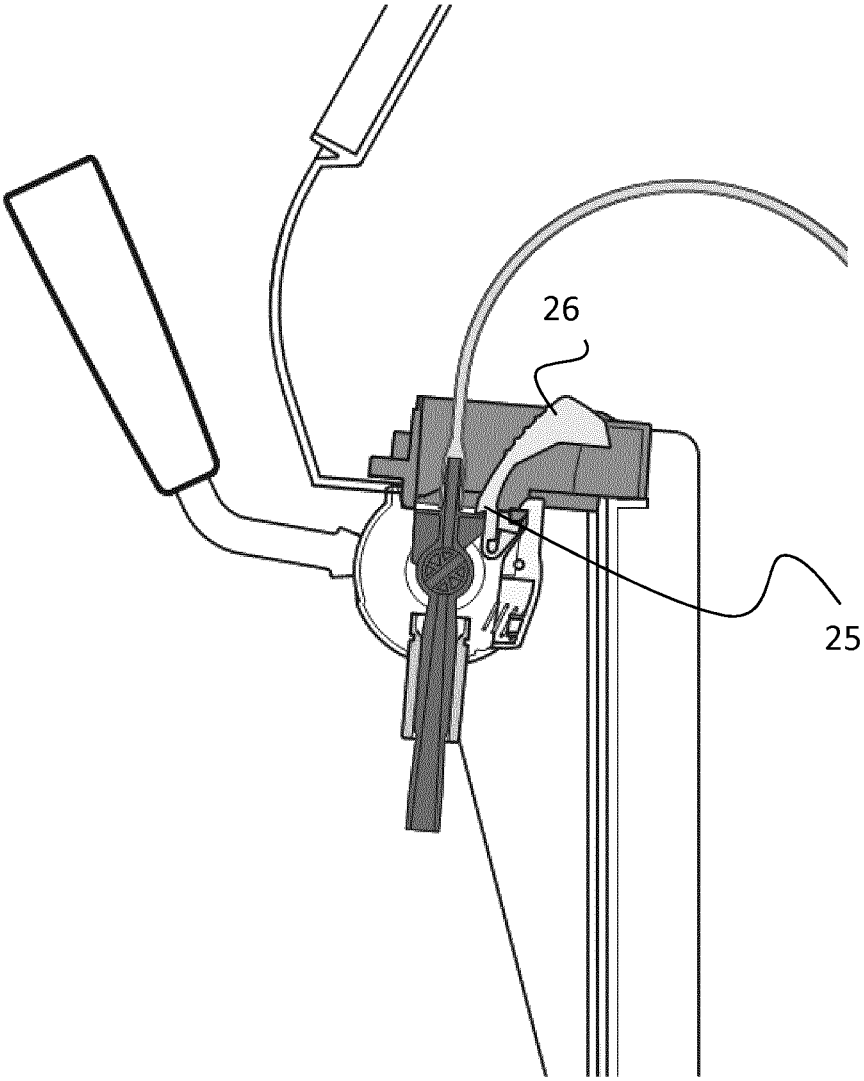
FIG. 6 is a sectional view of the beverage tap installation, according to an alternative embodiment of the present invention.
Figure 7:
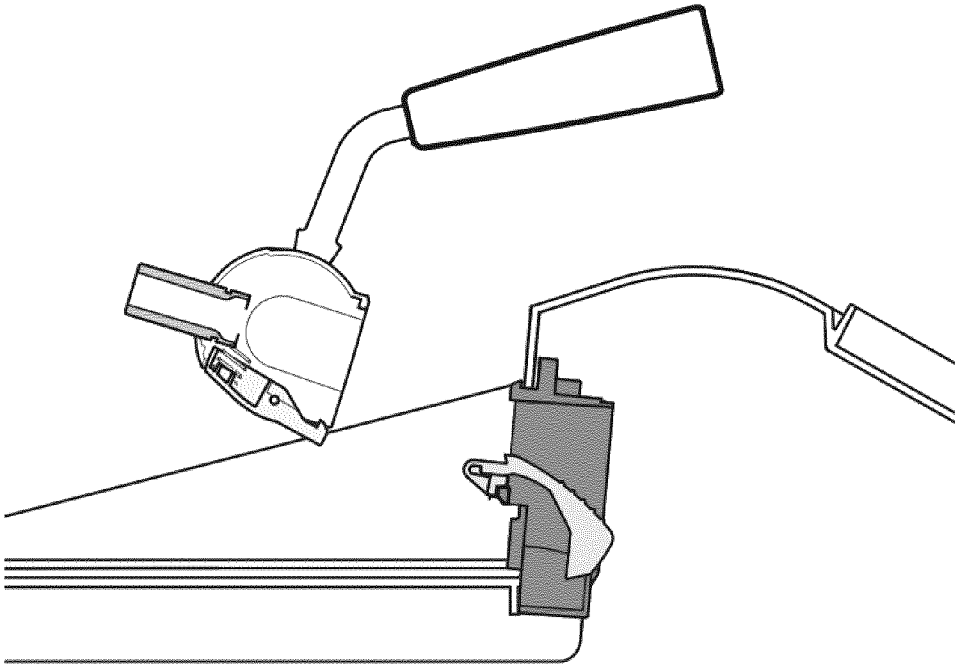
FIGS. 7, 8, 9 and 10 show the tap installation of FIG. 6 during several assembly steps.

FIG. 6 shows an alternative tap installation according to the present invention, wherein the engaging member is a shoulder portion 25 engaging the abutment surface 24 of the dispense tube 4, provided on a hinging arm 26 mounted in the tap housing and extending through the tap housing outlet 7 into the tap head receiving slot for engaging the abutment surface.

As with the embodiment described with reference to FIG. 1, this embodiment in FIG. 6 provides for a mechanism ensuring correct positioning of the valve in the valve receiving slot during attachment of the tap head to the tap housing and without any specific action of a user except for connecting the tap head to the tap housing and/or inserting the dispense tube in the tap head 3. As such the tap installation according to the invention offers a user friendly operation.

Figure 8:
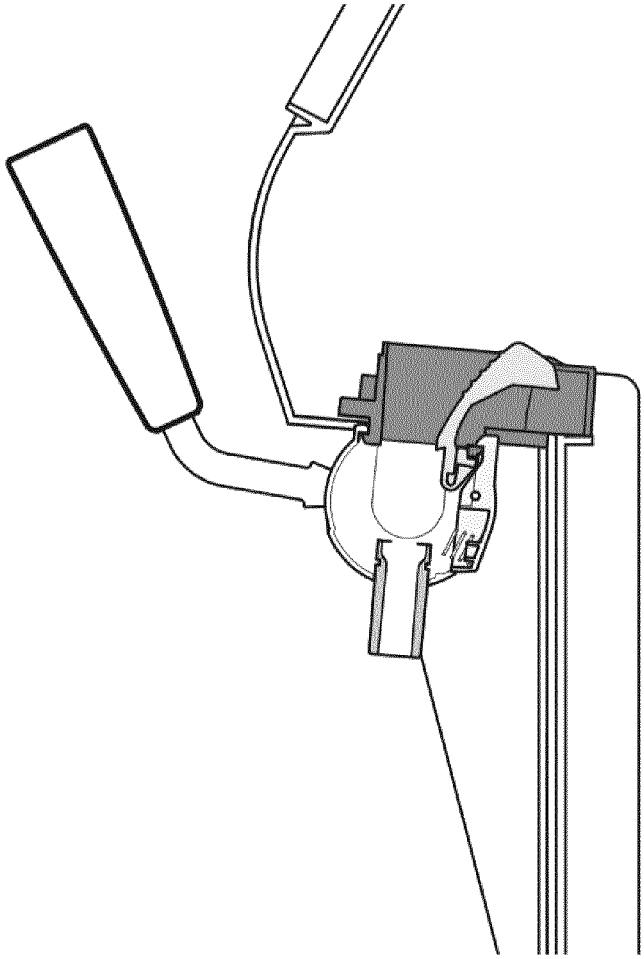
Figure 9:
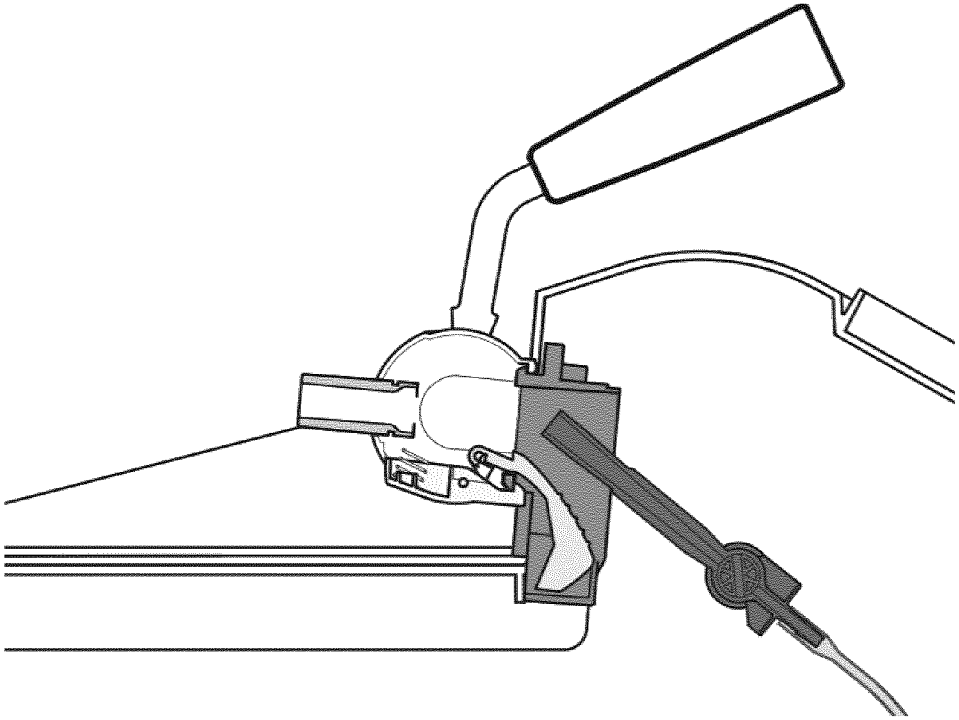
Figure 10:
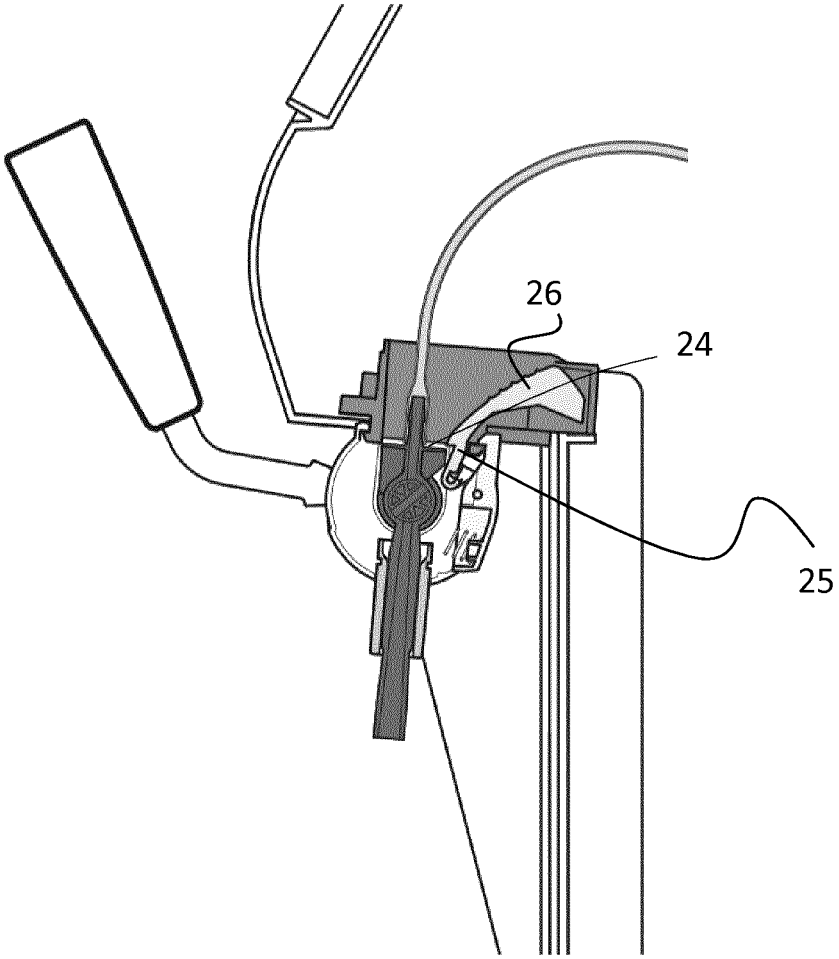

FIGS. 7 to 10, schematically illustrate the assembly of the tap installation of FIG. 6, wherein, contrary to the assembly of the embodiment depicted in FIG. 1, the dispense tube 4 can be inserted after mounting the tap head 3 on the tap housing 2. The mounting of the tap head to the tap housing is essentially similar to the mounting described above with reference to FIGS. 1 to 5 and involves the locking mechanism with the pair of hooks 13-14 on the tap housing interacting with the pair of L-shaped members 15-16 of the tap head 3 (FIG. 8). Once the tap head is mounted on the tap housing, the dispense tube 4 can be inserted with the beverage outlet into the tap head (via the tap head inlet 8). In this case the tap head inlet 8 is aligned with the tap housing outlet 7 for swift introduction of the dispense tube 4. As illustrated in FIG. 10, the rigid section 22 of the dispense tube 4 engages with a portion of the hinging arm 26, thereby rotating the hinging arm such that the shoulder portion 25 of the hinging arm 26 engages with the abutment surface 24 of the dispense tube 4, thereby blocking the dispense tube 4 in a correct position in the tap head 3.

Figure 11:
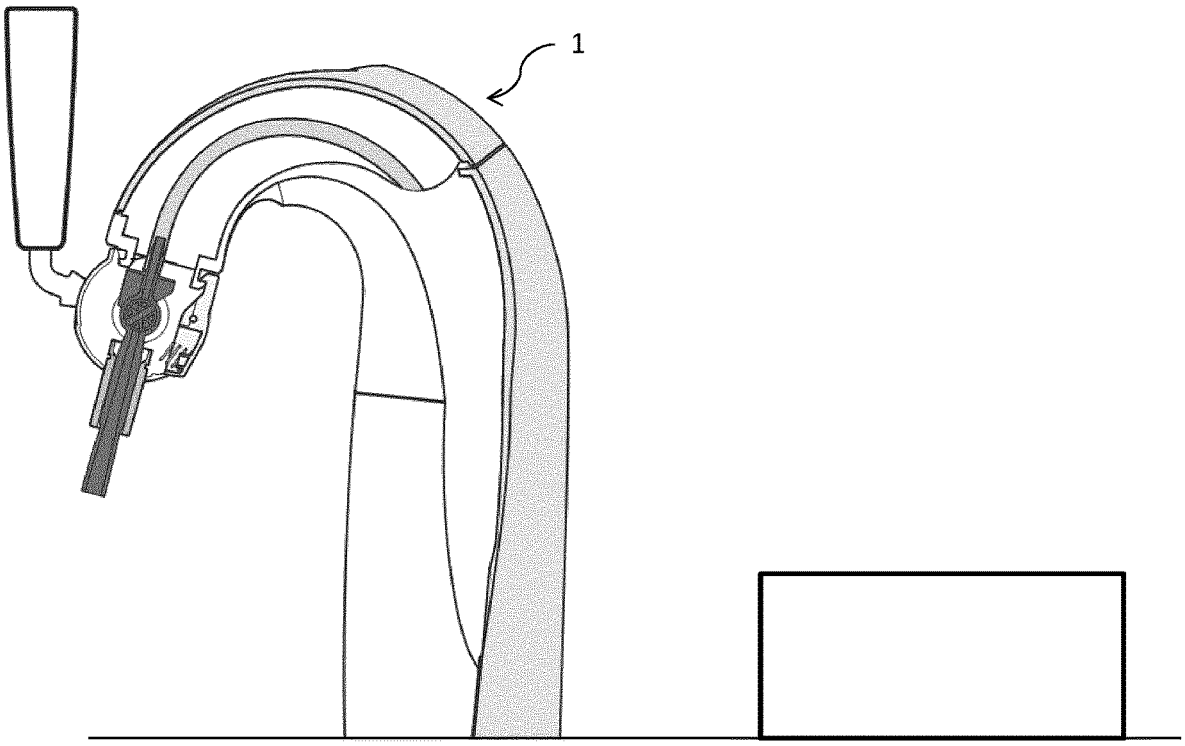
FIG. 11 is a schematic view of a counter with a tap installation according to the present invention provided thereon.
Figure 12:
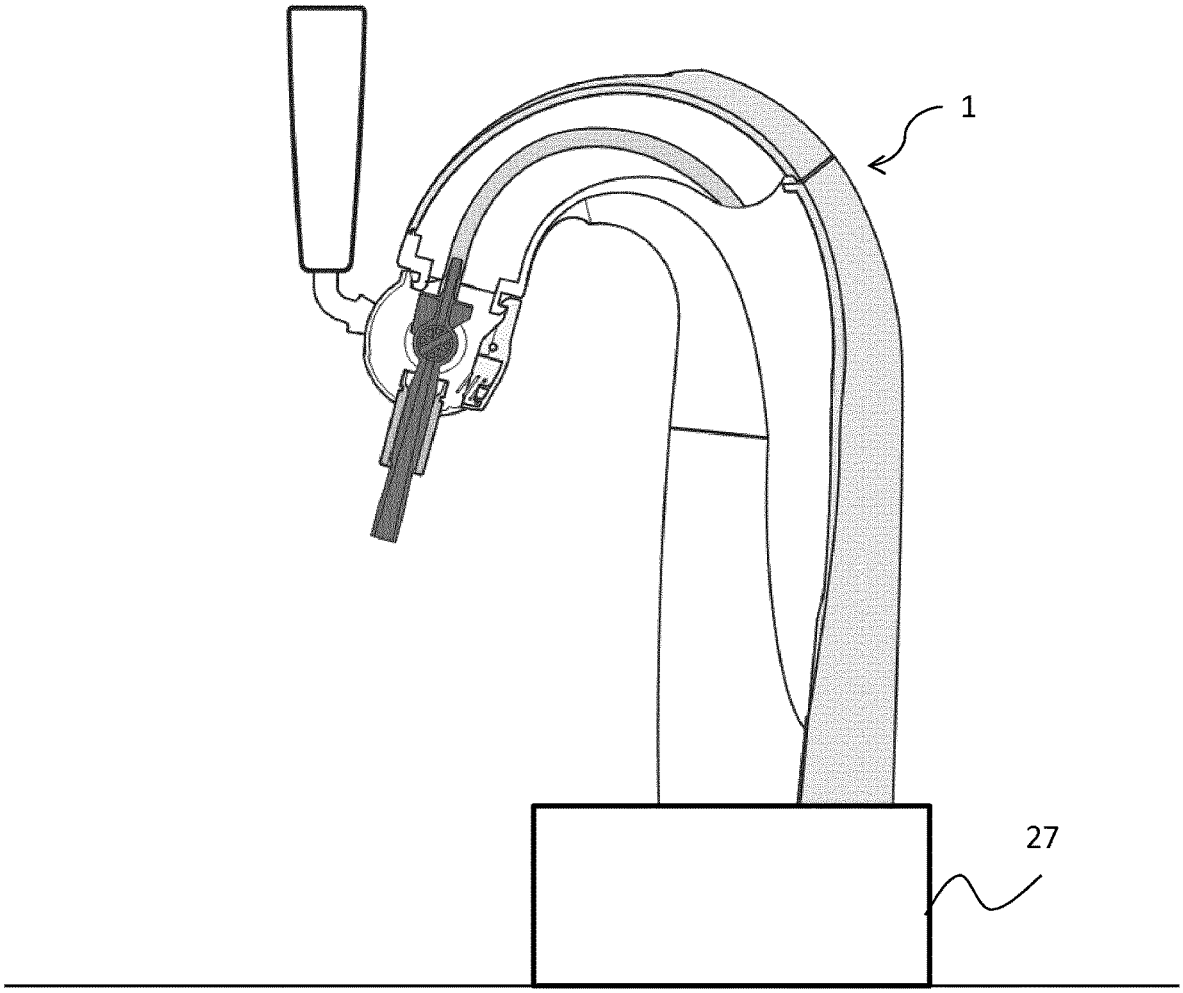
FIG. 12 is a schematic view of a beverage dispensing unit comprising a beverage tap installation according to the present invention.
Figure 13:
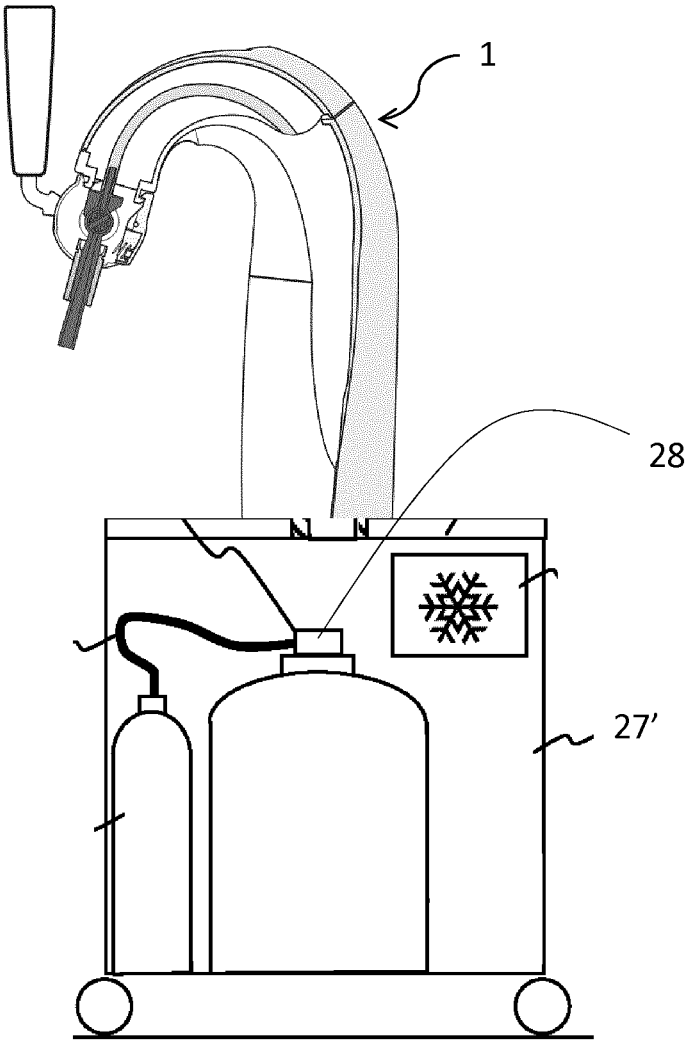
FIG. 13 is a schematic view of a roving beverage unit comprising a beverage tap installation according to the present invention.

FIGS. 11, 12 and 13 show a tap installation of the present invention in several arrangements in view of a beverage source.

FIG. 11 shows a tap installation according to the present invention mounted on top of a counter and with a beverage source located distant from the tap installation. Such setup is convenient when the beverage source is relatively large, eg a 20 to 50 liter keg.

FIG. 12 shows beverage dispensing unit comprising a beverage tap installation according to the present invention and comprising a beverage source receiving portion 27, such as a refrigerated space wherein a keg can be placed. In this case it is preferred that the dispense tube 4 of the beverage tap installation is coupled directly to an outlet of the beverage keg, for example by means of a keg connector with beverage valve 28 at the beverage inlet of the dispense tube 4. Such setup is convenient for medium to small size kegs of eg. 4 to 20 liters.

FIG. 13 shows a roving beverage dispensing unit comprising a beverage tap installation according to the present invention and comprising a beverage source receiving portion 27', such as a refrigerated space wherein a keg can be placed. In this case it is preferred that the dispense tube 4 of the beverage tap installation is coupled directly to an outlet of the beverage keg, for example by means of a keg connector with beverage valve 28 at the beverage inlet of the dispense tube 4.

The invention claimed is:

1. A beverage tap installation comprising:

a tap housing defining an inner cavity;

a tap head defining a liquid channel having an inlet and an outlet and a valve receiving slot defined in said liquid channel, the tap head comprises a valve actuator and a valve actuator operating mechanism;

a removable flexible dispense tube having a beverage inlet and a beverage outlet, the flexible dispense tube comprises a liquid valve lodged in the valve receiving slot and cooperates with the valve actuator of the tap head;

a locking mechanism allowing removably mounting of the tap head on the tap housing, the flexible dispense tube comprises an abutment surface in proximity of the valve and the tap installation comprises an engaging member provided on the tap installation and abuts the abutment surface of the dispense tube when the valve is lodged in the valve receiving slot and the tap head is mounted on the tap housing and in that the engaging member is provided on the tap housing.

2. The beverage tap installation according to claim 1, in which the engaging member is provided on a hinging arm mounted in the tap housing and configured to engage the abutment surface of the dispense tube upon inserting the dispense tube in the tap head.

3. The beverage tap installation according to claim 2, the abutment surface extends substantially perpendicular to the longitudinal direction of the dispense tube.

4. The beverage tap installation according to claim 2, wherein the locking mechanism and the valve actuator are separate parts of the tap installation.

5. The beverage tap installation according to claim 2, the flexible dispense tube comprises a rigid section wherein the valve is provided and defines the abutment surface.

6. The beverage tap installation according to claim 2, the beverage outlet of the dispense tube defines the spout of the tap installation.

7. The beverage tap installation according to claim 2, the dispense tube comprises a keg connector at the beverage inlet.

8. The beverage tap installation according to claim 1, the abutment surface extends substantially perpendicular to the longitudinal direction of the dispense tube.

9. The beverage tap installation according to claim 8, wherein the locking mechanism and the valve actuator are separate parts of the tap installation.

10. The beverage tap installation according to claim 8, the flexible dispense tube comprises a rigid section wherein the valve is provided and defines the abutment surface.

11. The beverage tap installation according to claim 8, the beverage outlet of the dispense tube defines the spout of the tap installation.

12. The beverage tap installation according to claim 8, the dispense tube comprises a keg connector at the beverage inlet.

13. The beverage tap installation according to claim 1, wherein the locking mechanism and the valve actuator are separate parts of the tap installation.

14. The beverage tap installation according to claim 13, the flexible dispense tube comprises a rigid section wherein the valve is provided and defines the abutment surface.

15. The beverage tap installation according to claim 13, the beverage outlet of the dispense tube defines the spout of the tap installation.

16. The beverage tap installation according to claim 13, the dispense tube comprises a keg connector at the beverage inlet.

17. The beverage tap installation according to claim 1, the flexible dispense tube comprises a rigid section wherein the valve is provided and defining the abutment surface.

18. The beverage tap installation according to claim 1, the beverage outlet of the dispense tube provides the spout of the tap installation.

19. The beverage tap installation according to claim 1, the dispense tube comprising a keg connector at the beverage inlet.

* * * * *